US008919060B1

(12) United States Patent
Oliver et al.

(10) Patent No.: US 8,919,060 B1
(45) Date of Patent: Dec. 30, 2014

(54) CONNECTOR AND FOUNDATION FOR MANUFACTURED BUILDING

(71) Applicants: Scott Oliver, Linden, TN (US); Daniel Oliver, Linden, TN (US); John Oliver, Linden, TN (US)

(72) Inventors: Scott Oliver, Linden, TN (US); Daniel Oliver, Linden, TN (US); John Oliver, Linden, TN (US)

( * ) Notice: Subject to any disclaimer, the term of this patent is extended or adjusted under 35 U.S.C. 154(b) by 307 days.

(21) Appl. No.: 13/624,001

(22) Filed: Sep. 21, 2012

(51) Int. Cl.
*E02D 27/48* (2006.01)

(52) U.S. Cl.
USPC ..... 52/292; 405/230

(58) Field of Classification Search
CPC ..... E02D 27/02; E02D 27/42; E02D 35/00
USPC ..... 52/292, 294, 296, 299; 405/230
See application file for complete search history.

(56) References Cited

U.S. PATENT DOCUMENTS

| | | | | |
|---|---|---|---|---|
| 4,261,149 | A * | 4/1981 | Gustafson | 52/292 |
| 4,417,426 | A * | 11/1983 | Meng | 52/126.7 |
| 4,546,581 | A | 10/1985 | Gustafson | |
| 4,863,137 | A | 9/1989 | Cockman | |
| 4,923,165 | A | 5/1990 | Cockman | |
| 4,937,989 | A * | 7/1990 | Miyares et al. | 52/126.7 |
| 5,603,187 | A * | 2/1997 | Merrin et al. | 52/58 |
| 5,666,774 | A * | 9/1997 | Commins | 52/298 |
| 6,058,663 | A | 5/2000 | MacKarvich | |
| 6,243,998 | B1 * | 6/2001 | MacKarvich | 52/167.3 |
| 6,256,940 | B1 | 7/2001 | MacKarvich | |
| 6,272,798 | B1 | 8/2001 | Cockman | |
| 6,318,032 | B2 | 11/2001 | MacKarvich | |
| 6,505,447 | B1 * | 1/2003 | Oliver et al. | 52/292 |
| 6,634,150 | B1 | 10/2003 | Oliver | |
| 7,140,157 | B2 | 11/2006 | Oliver | |
| 7,526,899 | B1 * | 5/2009 | Oliver et al. | 52/292 |
| 2005/0188627 | A1 | 9/2005 | Alberts | |

OTHER PUBLICATIONS

Oliver Technologies, Inc, Florida Installation Instructions for the Model 1101 "V" Series All Steel Foundation System ((Jun. 2007); 3 pages; Oliver Technologies, Inc., 467 Swan Avenue, Hohenwald, TN 38462.

Oliver Technologies, Inc., Anchor Pier for Manufactured Building, U.S. Appl. No. 12/858,027 (Aug. 17, 2010).

* cited by examiner

*Primary Examiner* — Jeanette E Chapman
*Assistant Examiner* — James Buckle, Jr.
(74) *Attorney, Agent, or Firm* — Baker Donelson Bearman Caldwell & Berkowitz PC

(57) ABSTRACT

A connector for a brace and a vertical post in a foundation for a manufactured building having support beams, the connector having a base and two opposing walls that each define an opening, a vertical support assembly having a plate that defines an opening and a tubular sleeve coaxial with an opening, which sleeve is coaxial with the openings in the walls when the plate is disposed on the base, and a threaded member extending from the tubular sleeve for engaging the vertical post. A fastener extends through the opening in one of the side walls, through the sleeve, through openings in a lower end of the brace, and through the opening in the opposing side wall, whereby the brace pivotably attaches to the base and the support assembly orients the threaded member vertically to support the vertical post. The connector used in a foundation for a manufactured building for connecting a brace and a vertical post to the manufactured building.

16 Claims, 5 Drawing Sheets

CONNECTOR AND FOUNDATION FOR MANUFACTURED BUILDING

FIELD OF THE INVENTION

The present invention relates to a foundation system for supporting a beam of a manufactured home. More particularly, the invention relates to a connector for a lateral brace and a vertical post in a foundation system that provides selective lateral or longitudinal stability and vertical support for a manufactured building.

BACKGROUND OF THE INVENTION

Manufactured buildings, mobile homes or trailer coaches include long longitudinal support beams underneath. Typically, when the building or coach is installed, a plurality of vertical piers or jacks are placed under the beams to support them. Most piers or jacks require placement on a rigid ground pan so as not to sink into the ground from the loading.

Conventional piers do not provide resistance to lateral or longitudinal forces that may be exerted on the manufactured building, such as by strong winds or earthquakes. Our U.S. Pat. No. 6,634,150 discloses a foundation for manufactured buildings that uses a lateral brace that pivotably attaches at a lower end to the ground pan under one of the support beams and attaches at an upper end to the other of the support beams. A separate pier is installed on the ground pan and contacts the support beam above the ground pan. The lateral brace enables the ground pan to resist lateral forces on the manufactured building while the pier supports the manufactured building. Similarly, the brace may be connected between the ground pan and the support beam over the ground pan, for resisting movement caused by longitudinal forces on the manufactured building.

Various types of vertical piers can be used. A pier may be constructed using cement blocks, steel members, and steel tubes. The cement blocks stack on the ground pan to a height just below the lower flange of the support beam. The stack is capped with wood plates that contact the support beam. Steel members used as a pier connect to a ground pan with a ground pan connector and to the support beam with a beam connector. A steel tube pier includes an extendable member that connects at an upper end of the tube to the support beam.

Because these support and bracing devices for foundation systems have to be installed in the field, it is desirable that they be simple to install, preferably by a single person, not require complex tools, and not require any alterations to the existing support beams, such as drilling, that could deleteriously affect the strength of the support beams.

Accordingly, there is a need in the art for connector for support members of a foundation system that provides vertical support and lateral or longitudinal stability for a manufactured building. It is to such that the present invention is directed.

SUMMARY OF THE INVENTION

The present invention meets the need in the art by providing a connector for use in a foundation for a manufactured building having at least an elongated support beam, the connector for securing an extending brace tube and a vertical post to a ground member under one of the beams, and the vertical post for connecting at an opposing end to the support beam and the brace tube for connecting at an opposing distal end to the support beam or to an adjacent support beam. The connector comprises a base and a pair of upstanding opposing side walls that each define an opening aligned with the opening in the opposing side wall. A vertical support assembly has a plate that defines an opening and a bottom edge and a tubular sleeve extending coaxially with the opening therein. The sleeve coaxially aligns with the openings in the opposing side walls when the plate is disposed with the bottom edge on the base. A threaded member extends from the tubular sleeve for engaging the vertical post. A fastener for extending through the opening in one of the side walls, through the sleeve of the support assembly, through openings in the brace tube, and through the opening in the opposing side wall. The brace tube thereby pivotably attaches at one end to the base and the support assembly orients the threaded member at an angle relative to the beam for the vertical post.

In another aspect, the present invention provides a foundation for a manufactured home having at least a first elongated support beam having opposing lower lateral flanges opposing upper lateral flanges. The foundation comprises a ground support for disposing on the ground beneath the first beam for vertically supporting the first beam and for interaction with the ground for resisting movement. A connector attaches to the ground support. The connector comprises a base and a pair of upstanding opposing side walls that each define an opening aligned with the opening in the opposing side wall, a vertical support assembly, and a fastener. The vertical support assembly has a plate that defines an opening and a bottom edge and a tubular sleeve extending coaxially with the opening therein. The sleeve coaxially aligns with the openings in the opposing side walls when the plate is disposed with the bottom edge on the base. A threaded member extends from the tubular sleeve. A fastener extends through the opening in one of the side walls, through the sleeve of the support member, and through the opening in the opposing side wall, for securing the vertical support assembly to the connector. A vertical post assembly comprises a first beam connector adapted for connecting to the lower lateral flange of the first support beam and a post and a threaded nut for engaging the threaded member extending from the sleeve. The post is supported by the nut engaged to the threaded member. The vertical post attaches at the opposing end to the first beam connector, for vertically supporting the first support beam and transferring the weight of the manufactured home to the ground support. A brace assembly comprises a second beam connector adapted for attachment selectively to the upper lateral flange of the support beam and an elongated brace having a bottom end pivotably attached by said connector upon being received between the side wall and the plate with bolt extending therethrough. A top end of the brace pivotably attaches to the second beam connector.

Objects, features and advantages of the invention will become more apparent upon a reading of the following detailed description in conjunction with the drawings and the claims.

DETAILED DESCRIPTION

Figure 1:
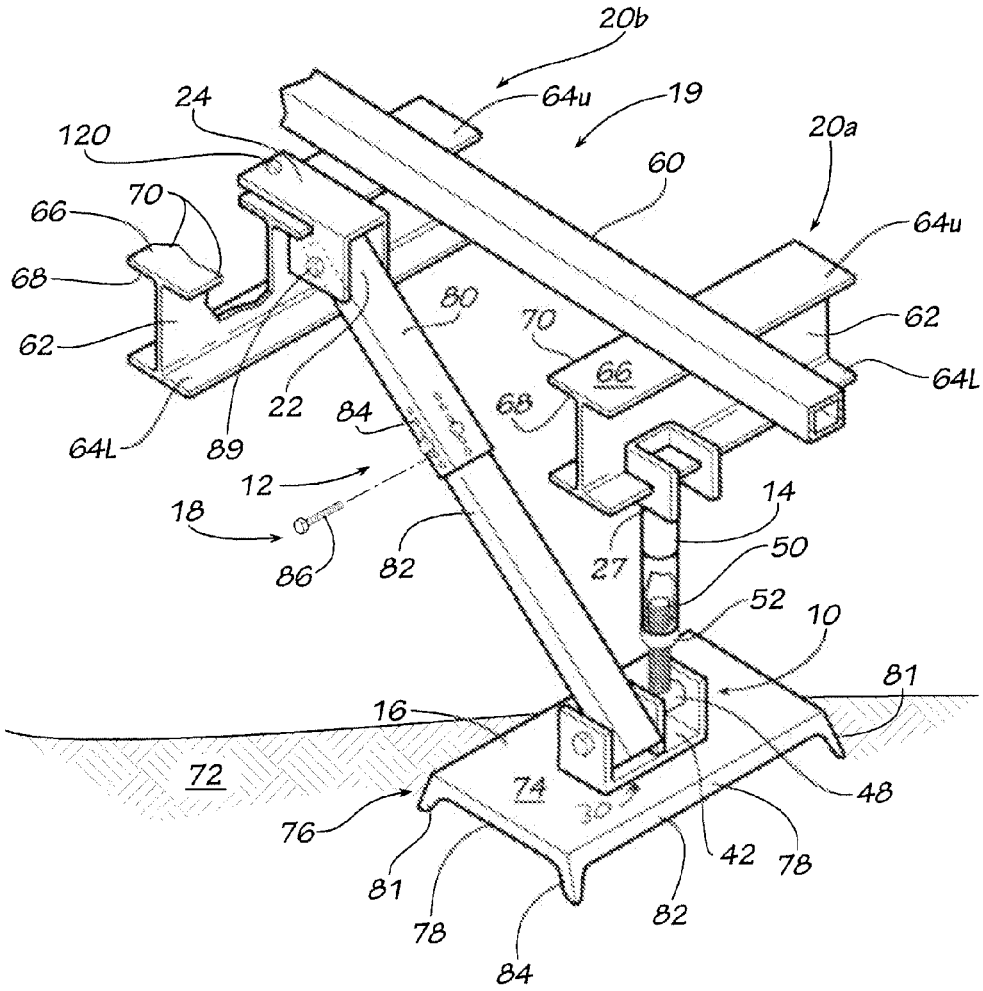
FIG. 1 illustrates in perspective view an embodiment of a connector in accordance with the present invention for support members of a foundation that provides lateral and vertical support for a manufactured building.

With reference now to the drawings, in which like parts have like identifiers, FIG. 1 illustrates in perspective view an embodiment of a connector 10 in accordance with the present invention. The connector 10 connects a brace 12 and a vertical post 14 (shown in partial cut-away) to a ground pan 16 of a foundation generally 18 for a manufactured building 19 having a pair of spaced-apart support beams 20. The illustrative embodiment provides for resistance to lateral forces on the building 19 communicated through the brace 12 to the ground pan 16, and the brace 12 is occasionally referenced as "the lateral brace 12". However, the connector 10 may be disposed so that the brace 12 orients parallel to the support beam 20 under which the ground pan seats rather than transverse to the support beam. Thus, the connector and the foundation may be gainfully used on a manufactured building having one support beam.

The foundation 18 provides lateral (or as noted above, longitudinal) and vertical loading support and resistance to movement for the manufactured building. The ground pan 16 sits on the ground underneath one of the support beams 20 below the manufactured building. The lateral brace 12 connects at an opposing end 22 to the other of the support beams 20 with a first beam connector 24 to resist lateral forces. An alternate implementation disposes the connector 10 so that the brace 12 is parallel to the support beam 20, for resisting longitudinal forces. The vertical post 14 connects at an opposing end to the support beam 20 above the ground pan 16 with a second beam connector 27.

Figure 2:
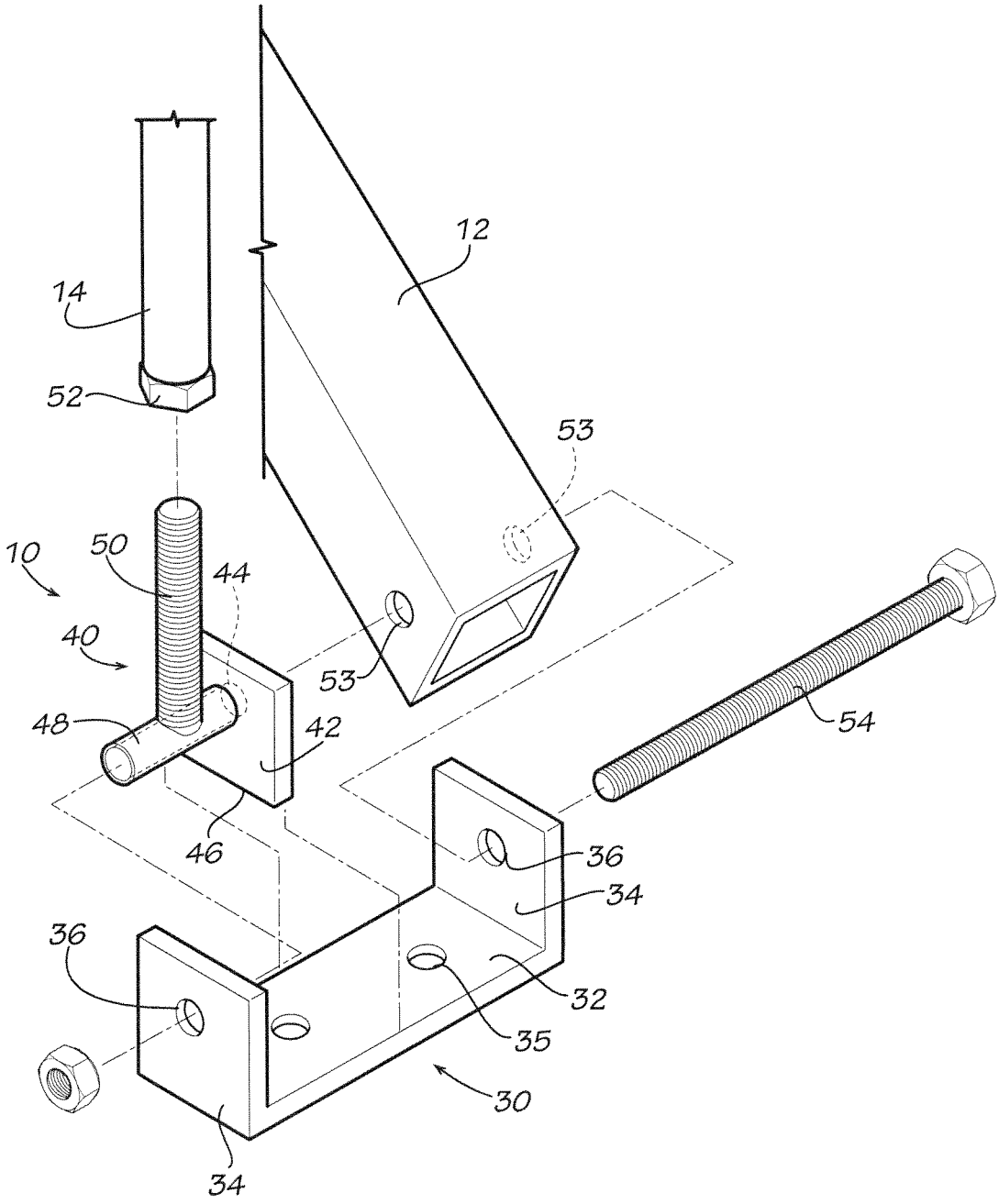
FIG. 2 illustrates an enlarged perspective exploded view of the connector shown in FIG. 1.

FIG. 2 illustrates an enlarged perspective exploded view of the connector 10. The connector 10 has a U-shaped bracket 30 with a base 32 and a pair of upstanding opposing side walls 34. Each side wall 34 defines an opening 36 that aligns with the opening in the opposing side wall. The base 32 defines at least one opening 35 for receiving a fastener (not illustrated) such as a bolt or other securing member to attach the bracket 30 to the ground pan 16. The base 32 may attach with other fastening means, such as welding.

A post support assembly 40 seats on the base 32 for supporting the vertical post 14 and for attaching the vertical post to the connector 10. The post support assembly 40 includes a plate 42 that defines an opening 44 and a bottom edge 46. A tubular sleeve 48 attaches to and extends from the plate 42. The sleeve 48 coaxially aligns with the opening 44 in the plate 42. When the post support assembly 40 is positioned with the bottom edge 46 on the base 32, the sleeve 48 coaxially aligns with the openings 36 in the opposing side walls 34. A threaded member 50 rigidly connects to the sleeve 48 and extends upwardly away from the base 32. A nut 52 may attach to the vertical post 14 and threads on the member 50 for a purpose discussed below. A lower end of the lateral brace 12 defines opposing openings 53. The lower end of the lateral brace 12 is received between the wall 34 and the plate 42. A single fastener 54 extends through the aligned openings 36, 53, 44 and sleeve 48, and opposing opening 36, and connects the lateral brace 12 and the post support assembly 40 to the bracket 30.

With continued reference to FIG. 1, the manufactured building 19 includes a plurality of parallel transverse floor joists 60 supported by the pair of support beams 20*a*, 20*b* that extend parallel to a longitudinal axis of the manufactured building. The support beams 20 are typical I-beams made such as of steel and are elongate, horizontal and parallel. Each support beam 20 includes a vertical web 62, a pair of opposing lateral flanges 64, such as upper and lower lateral flanges 64U and 64L respectively. Each flange 64 has an outer surface 66, an inner surface 68 and a free end 70, or with the I-beam 20 shown, two free ends 70. The support beams 20 are typically twelve inches in height and in a typical manufactured building are spaced apart ninety-six inches between webs 62. Although I-beams are shown and described, it is to be appreciated that foundation is applicable to other beams, such as C-beams, with only slight modifications.

As noted above, the foundation 18 generally comprises the ground pan 16, the lateral brace 12 with the beam connector 24, the vertical post 14 with the beam connector 27, and the connector 10.

The ground pan 16 is positioned on the ground 72 under a first beam 20*a*. The ground pan 16 provides support for the vertical post 14 and the lateral brace 12. The ground pan 16 includes a plate 74 having a downward facing lower surface for bearing on grade of ground 72. The ground pan 16 is made of strong stiff material, such as of steel or galvanized iron of twelve or greater gauge. Typical dimensions are twenty or twenty four inches square. The ground pan 16 includes an anchoring means 76 attached to the plate 72, such as ground insertion means 78, inserted in the ground 72, for preventing horizontal movement of the pan 16. The ground insertion means 78 may be any suitable means, such as spikes, but, preferably, has a large side surface for resisting lateral forces (or longitudinal forces if the foundation is configured for such).

In the illustrated embodiment, the ground insertion means 78 includes downward blades or cleats 80 about the periphery of pan 16. The illustrated embodiment includes cleat legs 81 in corners of the pan, which legs extend below a distal edge of the cleat wall between adjacent legs. The cleats 80 may be part of the plate 74 bent over or may be stiff angle members attached to plate. The cleats 80 present a wall, such as wall 82 transverse to the lateral brace 12, for bearing against the ground 72 for resisting lateral forces.

The vertical post 14 includes the nut 52 to connect through the connector 10 to the ground pan 16 and the upper end connects with the beam connector 27 to the support beam 20*a*. The vertical post 14 vertically supports the first support beam 20*a* and transfers the weight of the manufactured building 19 to the ground pan 16. The cleats 80 are driven into ground 72 and provide firm resistance to horizontal movement of the ground pan 16. As discussed below in reference to FIG. 4, the vertical post 14 in the illustrated embodiment includes a first tube 121 and a second tube 122 that telescope to a selected length. Fasteners extend through selected ones of a plurality of openings in the first tube 121 and engage the second tube 122 to secure the vertical post 14 at a selected length for extending between the ground pan 16 and the support beam 20. In an alternate embodiment, the vertical post 14 is a single tube.

The lateral brace 12 and beam connector 24 assembly provides resistance to lateral loads, such as produced by wind or earthquake. The lateral brace assembly 40 generally includes the connector 10, the beam connector 24, and the lateral brace 12 that extends between the connector 10 and the beam connector 24. The lateral brace 12 is an elongate, rigid member having a bottom end pivotably supported by the connector 10 and a top end pivotably attached to the beam connector 24.

The lateral brace 12 is adjustable in length and includes a first member, such as first elongate box tube 80 and a second member, such as second elongate box tube 82, selectively, longitudinally, slidably engaged with the first member for adjusting the length of brace 12. The second or lower tube 82 may be one and one-quarter inch square or a box tube and the first or upper tube 80 may be one and one-half inch box tube that telescopically slides over the second tube. Locking means between first and second tubes 80, 82, fixes their relative position and therefore fixes the length of the lateral brace 12. In the illustrated embodiment, the locking means includes a plurality of bores 84 in outer or first tube 80. One or more fasteners, such as self-tapping screws 86, are placed in bores 84 and attached to the inner or second tube 82. The connector 10 attaches to the ground pan 16 by any suitable means, such as by welding or a bolt extending through the opening 35 in the base 32 into a nut (not illustrated).

As noted above, the lower end of the lateral brace 12, such as the lower end of the second tube 82, defines openings 53 in opposing side walls of the tube. As discussed below, the fastener 54 extending through the openings 53, pivotably connects the lateral brace 12 to the connector 10.

Figure 3:
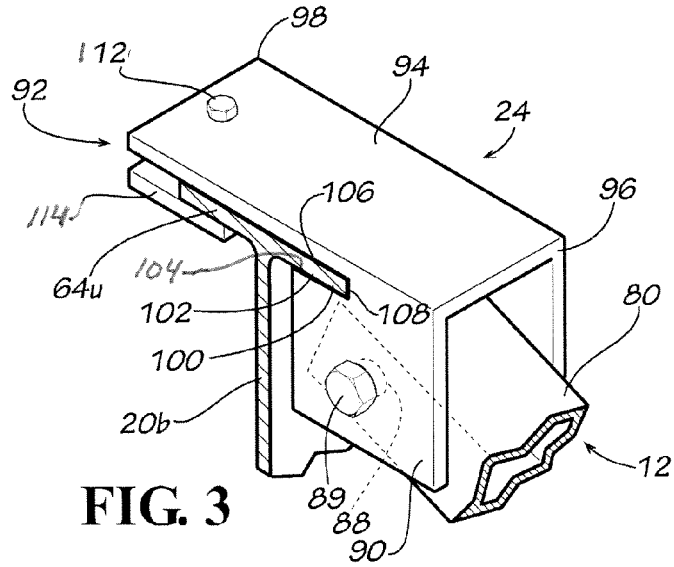
FIG. 3 illustrates an enlarged perspective view of a beam connector attached to a second beam of the manufactured building.

FIG. 3 illustrates an enlarged perspective view of the beam connector 24 attached to the second beam 20*b* of the manufactured building 19. Our earlier U.S. Pat. No. 6,634,150 discloses such a beam connector. The upper end of the lateral brace 12, such as the upper end of the first tube 80, defines openings 88 in opposing side walls of the tube. As discussed below, a fastener 89 extending through the openings, pivotably connects the lateral brace 12 to the beam connector 24.

The beam connector 24 attaches to the flange 64, such as on upper lateral flange 64U, of the second beam 20*b*. The beam connector 24 may instead attach to the lower flange 64L, but the upper flange 64U is attached to the floor joist 60 and, therefore, may be better supported and stronger.

The beam connector 24 generally includes a bracket 90 and retaining means 92. The bracket 90 includes a traversing portion 94 traversing an outer surface of the flange 64 of the second beam 20*b*. The traversing portion 94 includes a first end 96 and a second end 98. The bracket 90 includes a slot 100 including a first side 102 for bearing against inner surface 104 of the flange 64, a second opposing side 106, which may be part of traversing portion 94, for bearing on the outer surface of the flange 64, and an end 108 for bearing on the free end 70 of the flange 64. The slot 100 is adapted for receiving the flange 64 such that upward and downward forces are transferred between the lateral brace 12 and the flange 64 and compressive lateral forces are transferred from the lateral brace 12 to the flange 64.

The retaining means 92 includes a vertical member, such as a bolt 112, that passes downward through a bore in a second end portion of the traversing portion 94. The bolt 112 projects downward for contacting the side of beam 20*b* opposite the slot 100 such that tensile lateral forces are transferred from beam 20*b* to the beam connector 24 and to the lateral brace 12. Because the edges of the beam connector that define the slot 100 transfers the other forces, it can be appreciated that retaining means 92 need transfer only tensile forces. A plate 114, connected to bolt 112, helps retain the second end 98 of traversing portion 94 to the second beam 20*b*.

The top end of the lateral brace 12 pivotably attaches to the beam connector 24, such as by the pivot bolt 89 extending through aligned openings in the bracket 90 and the openings 88 in the lateral brace 12.

Figure 4:
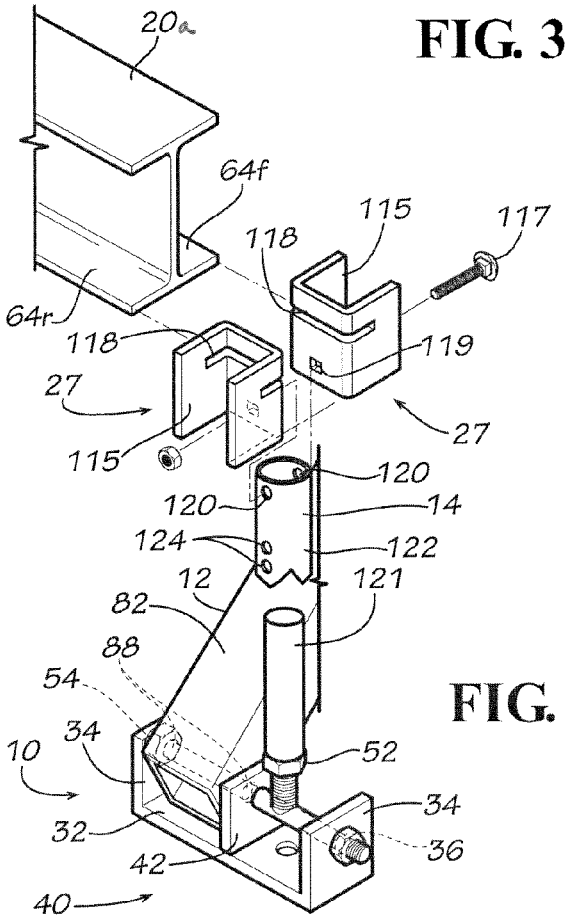
FIG. 4 illustrates an exploded perspective view of a beam connector for attaching the vertical post to the support beam of the manufactured building as illustrated in FIG. 1.

FIG. 4 illustrates an exploded perspective view of the beam connector 27 for attaching the vertical post 14 to the support beam 20 of the manufactured building 19 as illustrated in FIG. 1. The beam connector 27 includes a pair of flange mount members 115 and a connecting means, such as an adjustable tension member, such as carriage bolt 117 and nut. Each flange mount member 115 is a U-shaped channel that defines a slot 118 adapted for receiving a lateral portion of the flange 64. The slot 118 is disposed so that a lower portion of the flange mount member extends below the flange 64 and an opposing portion seats on the flange. The flange mount member 115 defines in the lower portion a bore 119 for receiving the bolt 117. Preferably, at least one of these bores 119 is adapted, such as by being square, to prevent the head of the bolt 117 from turning. In the illustrative embodiment, the flange mount members 115 are made of U-shaped steel.

The beam connector 27 attaches to the beam 20 by mounting one flange mount member 115 on a front flange 64*f* and an opposing flange mount member 115 on the rear flange 64*r*. An upper end of the vertical post 14 inserts between the opposing flange mount members 115. The upper end of the vertical post 14 defines opposing openings 120 that align with the openings 118. The bolt 117 extends first through one of the openings 118, through the openings 120 in the vertical post 14, and through the opening 118 in the opposing flange mount member. The nut threaded on the bolt 117 secures the beam connector 27 to the support beam 20 and to the upper end of the vertical post 14. As the nut is tightened on the bolt 117, the lower portions of the flange mount members are urged together to bind at least one of the flange mount members to the flange 64 and thus secured in place on the support beam 20.

Preferably, the flange mount members 115 have a depth such that when mounted on the flange, the members are sufficiently separated for more than enough room for upper end of the vertical post 14 to fit between the members and such that tightening of the nut on the bolt 117 pulls the lower ends towards each other and tilts them so as to bind the post. Similarly, the members 115 have a height such that forcing the lower ends together binds the slots 118 on the flanges 64*f*, 64*r* such that clamp 10 cannot move. In this manner, tightening the single bolt 115 clamps the beam connector 27 in a given location on the beam 20.

In the illustrated embodiment, the vertical post 14 comprises a first tube 121 and a second tube 122. The nut 52 may attach to one end of the first tube 121 opposing the end that receives the second tube 122. The second tube 122 defines in a first portion proximate one end of the tube a pair of opposing openings 120 through which the bolt 117 passes to attach the upper end of the vertical post 14 to the beam connector 27. The first tube 121 and the second tube 122 are sized for telescoping together, so that the length of the vertical post may be selectively set. The second tube 122 defines a plurality of openings 124 in a second portion of the tube remote from the first portion. Fasteners, such as metal screws (not illustrated), pass through the openings 124 and engage the first tube for securing the tubes 121, 122 together as the vertical post 14.

Figure 5:
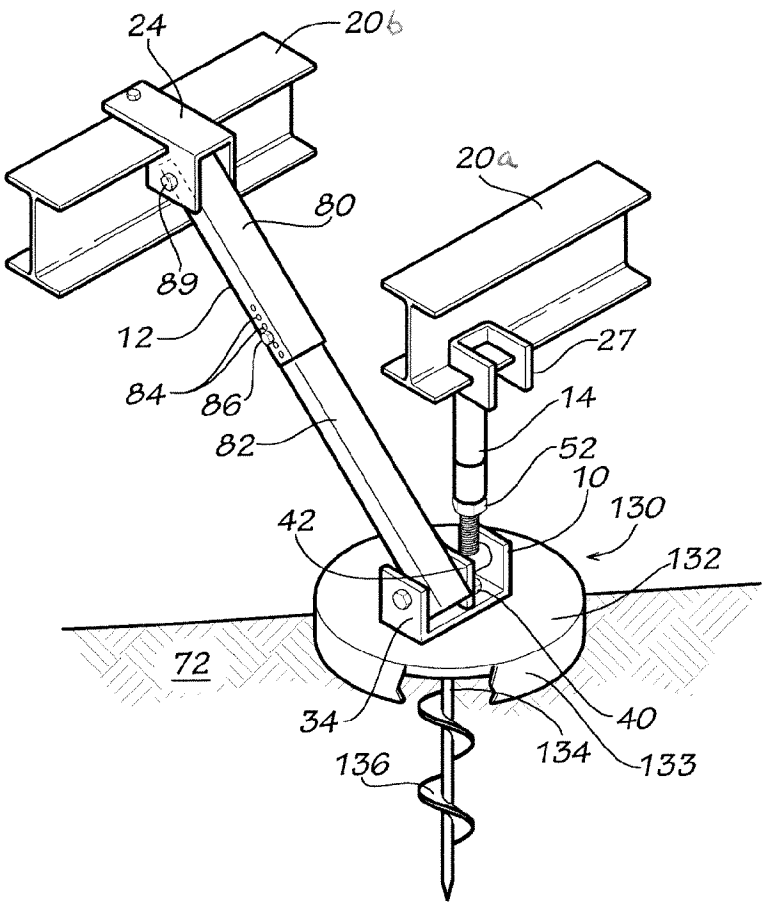
FIG. 5 illustrates in perspective view a second alternate embodiment of the connector.

FIG. 5 illustrates in perspective view a second alternate embodiment of the connector 10 included in a ground anchor 130. The connector 10 attaches to a plate 132 of the ground anchor 130 and a shaft 134 extends from an opposing side. One or more helical flights 136 attach to distal end portions of the shaft 134. The helical flights 136 guide the insertion of the shaft into the ground 72 for disposing the plate 132 at grade. The ground anchor 130 may be configured as a cap with a skirt or sidewall 133 that extends from the plate 132 in a first direction. As the helical flights 136 guide the insertion of the shaft into the ground, the sidewall 133 extends into the ground. The sidewall 133 of the cap resists movement of the ground anchor 130 from loading on the building transmitted through the lateral brace 12.

It is to be appreciated that rotating the connector 10 90° during installation orients the brace 12 parallel with the support beam 20*a*. The upper end of the brace 12 connects to the support beam 20*a*. The anchor 130 then resists longitudinal loading on the building.

Figure 6:
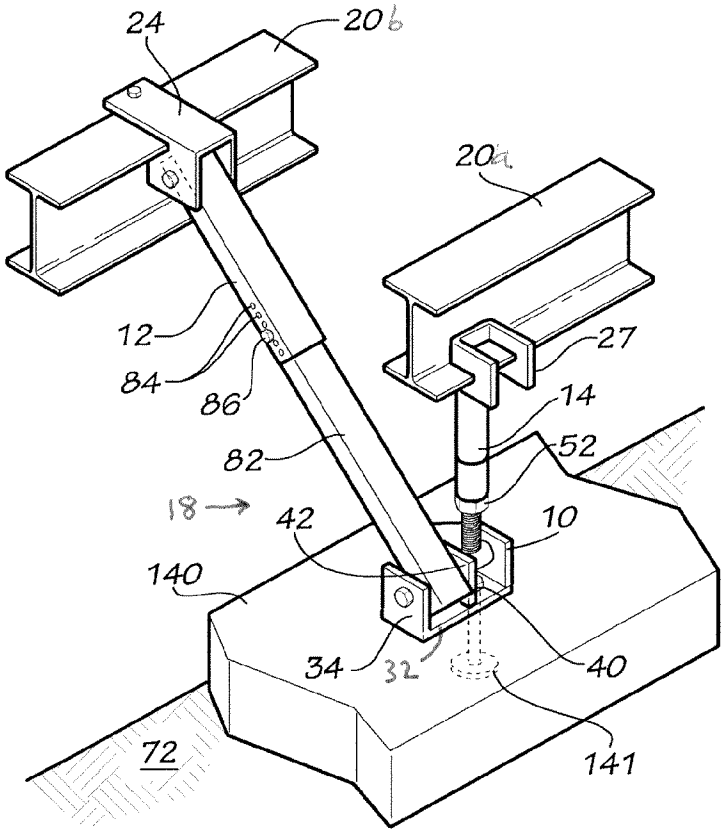
FIG. 6 illustrates in perspective view a third alternate embodiment of the connector.

FIG. 6 illustrates in perspective view a third alternate embodiment of the connector 10 attached to a cement body 140 that anchors the foundation 18 to the ground 72. In one aspect, the cement body 140 may be a pre-existing plate. A bore is drilled into the cement body and a fastener such as a threaded screw configured for secure installation in cement is driven through the opening in the base 32 and into the bore. In a second aspect, the cement body 140 is poured at site and before curing, the connector 10 is positioned on the cement body. A fixing member 141 extends through the opening in the base 32 and is received in the poured cement.

Figure 7:
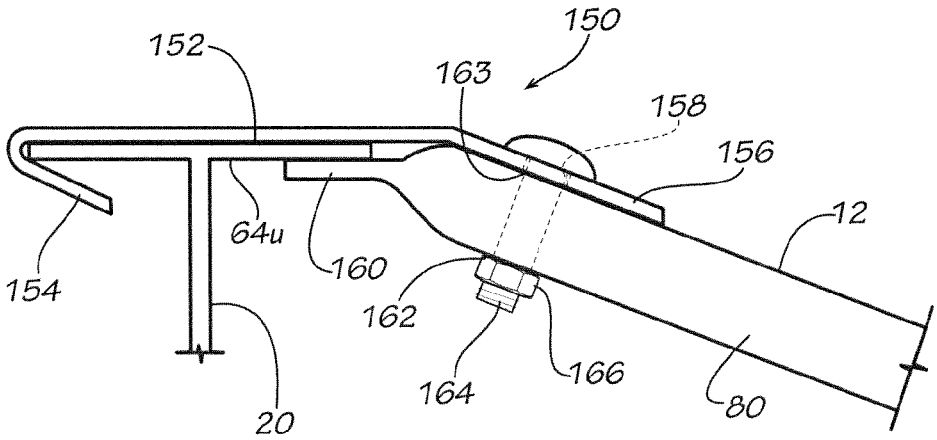
FIG. 7 illustrates in detailed side elevational view an alternate embodiment connector for attaching the brace to a support beam of a manufactured building.

FIG. 7 illustrates a detailed side elevational view of a connector 150 as an alternate embodiment for attaching the brace 12 to the support beam 20 of the manufactured building 19. The connector 150 comprises a plate having a planar transverse portion 152 with an end portion defining a hook 154 and an opposing angled connector portion 156. The angled portion 156 defines a through passageway or opening 158. The hook 154 extends over an edge of an upper flange 64U of the support beam 20. The planar transverse portion 152 seats on the upper surface of the upper flange 64U. An upper end 160 of the brace tube 80 is flattened, such as by compression or mechanical squeezing of the tubular walls of the upper tube 80. A pair of opposing holes 162, 163 are formed in opposing sidewalls of the tube 80.

The flattened end 160 bears against a lower surface of the flange 64U opposing the connector 150. A bolt 164 extends through the opening 158 in the angled portion 156, and through the openings 163, 162. A nut 166 threads on the fastener 164 to tightly secure the upper end of the tube 80 to the connector 150, and thus, secure the brace 12 to the support beam 20.

Figure 8:
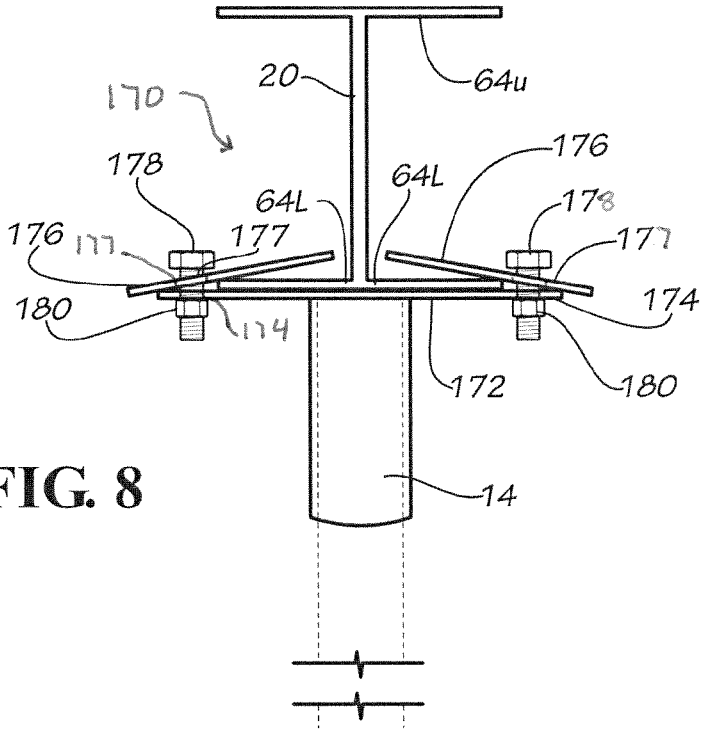
FIG. 8 illustrates in detailed side elevational view an alternate embodiment connector for attaching a vertical post to a support beam of a manufactured building.

FIG. 8 illustrates in detailed end view a connector 170 as an alternate embodiment for attaching the vertical post 14 to the support beam 20 of the manufactured building 19. A plate 172 rigidly attaches, such as by welding to an upper end of the vertical post 14. The plate 172 defines a pair of through passages or openings 174 on outward opposing portions of the plate 172. The plate 172 bears against a lower surface of the lower flange 64L of the support beam 20. A pair of plates 176 each define openings 177. The plates 176 seat on a respective opposing upper surfaces of the lower flange 64L with the opening 177 aligned with a respective one of the openings 174. A fastener 178 extends through the aligned openings 177, 174. A nut 180 threadably engages the bolt 178. The head of the bolt 178 bears against the plate 176 and the nut 180 bears against the plate 172. Tightening the nut 180 secures the plate 176 in bearing contact with the flange 64L of the support beam, and secures the plate 172 in bearing contact with the lower surface of the flange 64L, thereby connecting the vertical post 14 to the support beam 20.

With reference to FIGS. 1 and 2, the connector 10 secures both the lateral brace 12 and the vertical post 14 to the ground pan 16 during installation of the foundation 18 for the manufactured building 19. The connector 10 first attaches to the ground pan 16. This is accomplished with a bolt extending through the opening 35 in the base 32 and an opening in the ground pan 16, and the bolt is secured by a nut.

The ground pan 16 is positioned horizontally on grade below the first support beam 20*a*. The lateral brace 12 is placed on the ground with the lower end on the bracket 30 and the openings 53 in the side walls aligned with the opening 36 in the side wall 34 of the bracket 30. The length of the telescoping lateral brace 12 is selected and fixed so that the lateral brace extends to the beam connector 24. The length is fixed by inserting the screws 86 in the bores 84 of the tube 80 after telescopically receiving the tube 82.

The post support assembly 40 seats with the bottom edge 46 on the base 32. The bottom edge 46 disposes the threaded member 50 vertical and extending away from the base 32 toward the support beam 20*a*. The fastener 54 then inserts through the aligned openings of the bracket 30, the post support assembly 40, and the lateral brace 12. The fastener 54 extends through the opening 36 in one of the side walls 34, through the openings 53 in the lower end of the lateral brace 12, through the opening 44 in the plate 42, through the sleeve 48, and through the opening 36 in the opposing side wall 34. A nut is securely received on the fastener 54. The lateral brace 12 is thereby pivotably attached to the connector 10 and the threaded member 50 is vertically disposed by the bottom edge 46 in contact with the base 32 for receiving the vertical post 14.

The nut 52 threads on the threaded member 50. The nut may be attached to the lower end of the vertical post 14. The upper end of the vertical tube 14 attaches to the beam connector 27, as discussed above regarding FIG. 4. The lateral brace 12 is pivoted upwardly and the upper end engaged with the fastener 89 to the beam connector 24, as discussed above regarding FIG. 3. It is to be appreciated that the alternate embodiment beam connector 150 shown in FIG. 7 may be used for connecting upper end of the brace 12 to the beam 20. The alternate embodiment beam connector 170 shown in FIG. 8 may be used for connecting the upper end of the vertical post 14 to the support beam 20.

The vertical post 14 communicates loading from the manufactured building 19 to the ground 72. The brace 12 communicates loading or forces on the building (lateral or longitudinal depending on installation orientation), to the ground and resists movement of the ground pan.

Having described the invention, it can be seen that it provides a very convenient and readily assembled foundation for supporting a manufactured building while simultaneously providing resistance to lateral (or longitudinal) forces on the manufactured building 19. The connector 10 for the brace 12 and the vertical post 14 of the foundation 18 is easy to set up in the field with a minimum of tools and personnel.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

What is claimed is:

1. In a foundation for a manufactured building having at least a pair of spaced-apart elongated beams, a connector for securing a brace tube and a vertical post to a ground member under one of the beams, the vertical post for connecting at an opposing end to the one of the beams and the brace tube for connecting selectively at a distal end to said one of the beams or to another one of the beams, the connector comprising:

a base and a pair of upstanding opposing side walls that each define an opening aligned with the opening in the opposing side wall;

a vertical support assembly having a plate that defines an opening and a bottom edge and a tubular sleeve extending coaxially with the opening therein, and the sleeve coaxially aligns with the openings in the opposing side walls when the plate is disposed with the bottom edge on the base, and a threaded member extending from the tubular sleeve for engaging the vertical post; and a fastener for extending through the opening in one of the side walls, through the sleeve of the support assembly, through opposing openings in the brace tube, and through the opening in the opposing side wall, whereby the brace tube pivotably attaches to the base and the support assembly orients the threaded member at an angle relative to the beam for the vertical post.

2. The connector as recited in claim 1, wherein the base comprises a plate from which a shaft extends and the shaft having a helical flight proximate a distal end for anchoring the plate to the ground.

3. The connector as recited in claim 1, further comprising means for connecting the base to a ground support.

4. The connector as recited in claim 3, wherein means for connecting comprises:

the base defining at least one opening; and a fastener extending through the opening to secure the base to the ground support.

5. The connector as recited in claim 4, wherein the ground support is a metal pan.

6. The connector as recited in claim 4, wherein the ground support is a cementatious body.

7. The connector as recited in claim 3, wherein means for connecting comprises a member extending from the base for being engaged to the ground support.

8. The connector as recited in claim 7, wherein the ground support is a metal pan.

9. The connector as recited in claim 7, wherein the ground support is a cementatious body.

10. A foundation for a manufactured home having first and second elongated support beams, each having a lower lateral flange and an upper lateral flange, said foundation comprising:

a ground support for disposition on the ground beneath the first beam for vertically supporting the first beam and for interaction with the ground for resisting movement;

a connector attached to the ground support, the connector comprising:

a base and a pair of upstanding opposing side walls that each define an opening aligned with the opening in the opposing side wall;

a vertical support assembly having a plate that defines an opening and a bottom edge and a tubular sleeve extending coaxially with the opening therein, and the sleeve coaxially aligns with the openings in the opposing side walls when the plate is disposed with the bottom edge on the base, and a threaded member extending from the tubular sleeve; and a fastener for extending through the opening in one of the side walls, through the sleeve of the support member, and through the opening in the opposing side wall, for securing the vertical support assembly to the connector;

a vertical post assembly comprising:

a first beam connector adapted for connecting to a lower lateral flange of the first support beam;

a nut received on the threaded member of the connector; and a post for receiving the threaded member extending from the sleeve and attached at the opposing end to the first beam connector, for vertically supporting the first support beam and transferring the weight of the manufactured home to the ground support; and a brace assembly comprising:

a beam connector adapted for attachment selectively to the first beam or to second beam; and an elongated brace having a bottom end pivotably supported by said connector and a top end pivotably attached to said beam connector.

11. The foundation as recited in claim 10, wherein the lower end of the brace defines opposing openings that align with the opening in the side wall of the connector and the plate, for receiving therethrough the fastener for pivotably supporting the brace by the connector.

12. The foundation as recited in claim 10, wherein the vertical post comprises:

a first tube and a second tube sized for telescoping together to a selected length; and fastening means for securing the first tube to the second tube for holding the selected length of the vertical post.

13. The foundation as recited in claim 12, wherein the nut attaches to an end of the first tube opposing the end that receives the second tube.

14. The foundation as recited in claim 10, wherein the lateral brace comprises:

a first tube and a second tube sized for telescoping together to a selected length; and fastening means for securing the first tube to the second tube for holding the selected length of the lateral brace.

15. The foundation as recited in claim 10, wherein the first beam connector comprises:

a first plate attached to an upper end of the vertical post and defining two through passages in outward opposing portions of the first plate;

a pair of second plates, each defining a through passage; and a pair of fasteners, each for extending through the aligned through passages of a respective one of the second plates and the first plate, whereby upon disposing the first plate against a lower surface of the support beam and disposing the second plates on respective opposing upper surfaces of the lower flanges of the support beam and aligning the respective through passages, a respective one of the fasteners extending through the aligned through passages and secured with a nut, connect the vertical post to the beam.

16. The foundation as recited in claim 10, wherein the second beam connector comprises a plate with a first end portion angled to define a hook for being received over an upper flange of the support beam and an opposing portion of the plate defining an opening therethrough;

the tubular member of the brace having a flattened end portion and an adjacent portion defining aligned through holes in the sidewalls of the brace; and a bolt for extending through the opening in the opposing portion of the plate aligned with the openings in the brace, whereby the hook portion being engaged to the upper flange of the support beam and the flattened end of the beam disposed against the lower surface of the upper flange and the openings in the brace aligned with the opening in the opposing portion of the plate, the bolt extending through the aligned openings and secured with a nut attaches the brace to the beam.

* * * * *